US011806781B2

(12) United States Patent
Niitsuma et al.

(10) Patent No.: US 11,806,781 B2
(45) Date of Patent: Nov. 7, 2023

(54) SUBMERGED ENTRY NOZZLE

(71) Applicant: SHINAGAWA REFRACTORIES CO., LTD., Tokyo (JP)

(72) Inventors: Hiroyasu Niitsuma, Tokyo (JP); Takayuki Matsunaga, Tokyo (JP); Ryota Okazaki, Tokyo (JP); Keigo Fujita, Tokyo (JP)

(73) Assignee: SHINAGAWA REFRACTORIES CO., LTD., Tokyo (JP)

( * ) Notice: Subject to any disclaimer, the term of this patent is extended or adjusted under 35 U.S.C. 154(b) by 0 days.

(21) Appl. No.: 17/789,016

(22) PCT Filed: Aug. 7, 2020

(86) PCT No.: PCT/JP2020/030452
§ 371 (c)(1),
(2) Date: Jun. 24, 2022

(87) PCT Pub. No.: WO2021/131139
PCT Pub. Date: Jul. 1, 2021

(65) Prior Publication Data

US 2023/0058990 A1 Feb. 23, 2023

(30) Foreign Application Priority Data

Dec. 27, 2019 (JP) ..... 2019-239381

(51) Int. Cl.
*B22D 41/52* (2006.01)

(52) U.S. Cl.
CPC ..... *B22D 41/52* (2013.01)

(58) Field of Classification Search
CPC ..... B22D 41/50; B22D 41/52
See application file for complete search history.

(56) References Cited

U.S. PATENT DOCUMENTS

2007/0158884 A1 7/2007 Tsukaguchi
2011/0240688 A1* 10/2011 Mizobe ..... B22D 41/50 222/591
2023/0058990 A1* 2/2023 Niitsuma ..... B22D 41/52

FOREIGN PATENT DOCUMENTS

JP 8-294757 11/1996
JP 11-320046 11/1999
(Continued)

OTHER PUBLICATIONS

International Search Report and Written Opinion of The International Searching Authority dated Nov. 2, 2020 in International (PCT) Application No. PCT/JP2020/030452, With partial English translation.

*Primary Examiner* — Scott R Kastler
(74) *Attorney, Agent, or Firm* — Wenderoth, Lind & Ponack, L.L.P.

(57) ABSTRACT

A submerged entry nozzle includes a bottomed cylinder having a vertical side face with at least two outlet ports and having an inner side and an outer side. The outlet port satisfies the following expressions:

$Vi/Vo \geq 1.1$ Expression (1)

$Ho/Hi \geq 1.1$ Expression (2)

where Vi indicates a vertical opening dimension of each of the at least two outlet ports on the inner side, Hi indicates a horizontal opening dimension of each of the at least two outlet ports on the inner side, Vo indicates a vertical opening dimension of each of the at least two outlet ports on the outer side, and Ho indicates a horizontal opening dimension of each of the at least two outlet ports on the outer side.

3 Claims, 6 Drawing Sheets

(56) References Cited

FOREIGN PATENT DOCUMENTS

| | | | | |
|---|---|---|---|---|
| JP | 2001-232449 | | 8/2001 | |
| JP | 2005-28387 | | 2/2005 | |
| JP | 2007-216272 | | 8/2007 | |
| JP | 2009-106968 | | 5/2009 | |
| WO | WO-2008090146 | A1 * | 7/2008 | ..... B22D 41/50 |

* cited by examiner

SUBMERGED ENTRY NOZZLE

TECHNICAL FIELD

The present invention relates to a submerged entry nozzle that can be used to continuously cast molten metal, such as steel. More specifically, the present invention relates to the shape of a discharge hole of the submerged entry nozzle.

BACKGROUND ART

A submerged entry nozzle is a tubular refractory nozzle that is used to supply molten steel from a tundish to a mold. Main roles of the submerged entry nozzle include preventing reoxidation of molten steel by preventing contact with air, and stably supplying molten steel into the mold.

A molten steel flow discharged from a discharge hole (hereinafter referred to as "discharge flow") branches into a short-side downward flow that descends along a short side of the mold after the molten steel collides with this short side, and a meniscus flow that flows along a meniscus toward the nozzle after the molten steel rises along the short side. The velocities of the short-side downstream flow and the meniscus flow are controlled by, for example, the flow velocity of the discharge flow when colliding with the short side and the position of this collision. If the discharge flow collides with a deep portion of the mold, the flow velocity of the short side downward flow increases, whereas the flow velocity of the meniscus flow decreases. Conversely, if the collision position is shallower, the flow velocity of the short-side downward flow decreases, but the flow velocity of the meniscus flow increases. An excessively large flow velocity of the meniscus flow increases the risk of incorporating mold powder slag located above the molten steel. On the contrary, an excessively large flow velocity of the short-side downward flow inhibits flotation of inclusions, gas bubbles, and the like mixed in the molten steel, and increases the risk that they are captured in a cast piece. Both cases are not favorable from the viewpoint of maintaining and improving the quality of the steel. Therefore, submerged entry nozzles have been designed to keep a balance such that neither the meniscus flow nor the short-side downward flow is excessively fast.

To simultaneously reduce the flow velocity of the meniscus flow and the flow velocity of the short-side downward flow, the simplest method is to increase the inner tube diameter of the submerged entry nozzle and the opening area of the discharge hole. However, the outer shape of the submerged entry nozzle is determined by the mold dimensions, and there is therefore a limit in the method of increasing the inner tube diameter of the submerged entry nozzle. For this reason, various examinations have been conducted on the shape of the discharge hole. For example, JP 2009-106968A (Patent Document 1) discloses a discharge hole having a shape expanding in a horizontal direction while extending from the inner side to the outer side of a tubular body that forms the submerged entry nozzle. JP 2011-212725A (Patent Document 2) discloses a method in which attention is paid to the fact that the flow velocity of the discharge flow in a general submerged entry nozzle is faster on the lower side of the discharge hole and slower on the upper side, and thus discharge from the upper side of the discharge hole is promoted in order to average the flow velocities of the discharge flows and reduce the fastest value of the discharge flow velocities. The techniques such as those of Patent Documents 1 and 2 can reduce the flow velocity of the discharge flow.

PRIOR ART DOCUMENTS

Patent Documents

Patent Document 1: JP 2009-106968A
Patent Document 2: JP 2011-212725A (or U.S. Patent Application Publication No. 2011/0240688)

DISCLOSURE OF THE INVENTION

Problem to be Solved by the Invention

However, in the technique such as that of Patent Document 1, expansion of the discharge hole on the outer side of the tubular body may be limited by the outer shape of the submerged entry nozzle. Further, the technique such as that of Patent Document 2 may not provide a sufficient effect of reducing the flow velocity of the discharge flow. For these reasons, the techniques such as those of Patent Documents 1 and 2 are not sufficient for achieving high throughput and high steel quality that are required for recent steelmaking.

It is therefore desired to realize a submerged entry nozzle capable of significantly reducing the flow velocities of both the meniscus flow and the short-side downward flow.

Means for Solving Problem

The present inventors have found that both the flow velocity of the meniscus flow and the flow velocity of the short-end downstream flow can be significantly reduced by generating a disturbance effect in the discharge flow to consume kinetic energy of the discharge flow. Therefore, the present inventors examined various shapes of the outlet port of the submerged entry nozzle, clarified shape conditions of the discharge hole that can effectively generate a disturbance effect in the discharge flow, and completed the present invention.

A submerged entry nozzle according to the present invention includes a bottomed cylinder having a vertical side face with at least two outlet ports and having an inner side and an outer side, wherein the following expressions are satisfied:

$$Vi/Vo \geq 1.1 \quad \text{Expression (1)}$$

$$Ho/Hi \geq 1.1 \quad \text{Expression (2)}$$

where Vi indicates a vertical opening dimension of each of the at least two outlet ports on the inner side, Hi indicates a horizontal opening dimension of each of the at least two outlet ports on the inner side, Vo indicates a vertical opening dimension of each of the at least two outlet ports on the outer side, and Ho indicates a horizontal opening dimension of each of the at least two outlet ports on the outer side.

This configuration can significantly reduce both the flow velocity of the meniscus flow and the flow velocity of the short-side downward flow. As a result, the quality of a cast piece can be improved by suppressing the case where inclusions in molten steel are incorporated in the cast piece and the case where mold powder slag is incorporated in the molten steel due to changes in the molten metal surface.

Hereinafter, preferable modes of the present invention will be described below. However, the following preferable modes do not limit the scope of the present invention.

It is preferable that the following expressions are satisfied:

$$Li < Lm < Lo \quad \text{Expression (3) or}$$

$$Li > Lm > Lo \quad \text{Expression (4),}$$

where Li indicates an upper edge height on the inner side, the upper edge height being a distance between an upper edge of each of the at least two outlet ports and a leading end of the bottomed cylinder, Lo indicates the upper edge height on the outer side, and Lm indicates the upper edge height at a position between the inner side and the outer side, and $$Mi<Mm<Mo \quad \text{Expression (5) or}$$

$$Mi>Mm>Mo \quad \text{Expression (6),}$$

where Mi indicates a lower edge height on the inner side, the lower edge height being a distance between a lower edge of each of the at least two outlet ports and the leading end of the bottomed cylinder, Mo indicates the lower edge height on the outer side, and Mm indicates the lower edge height at a position between the inner side and the outer side.

This configuration makes it even easier to achieve the effect of reducing the flow velocities of the meniscus flow and the short-side downward flow.

It is more preferable that the upper edge height satisfies Expression (4), and the lower edge height satisfies Expression (5).

This configuration makes it even easier to achieve the effect of reducing the flow velocities of the meniscus flow and the short-side downward flow.

Further features and advantages of the present invention will become more apparent through the illustrations of the following exemplary and non-limiting embodiments described with reference to the drawings.

DETAILED DESCRIPTION OF PREFERRED EMBODIMENTS

An embodiment of a submerged entry nozzle according to the present invention will be described with reference to the drawings. The following is a description of an example of applying the submerged entry nozzle according to the present invention to a submerged entry nozzle 1 for a continuous slab-casting machine. The present embodiment envisions application to a continuous slab-casting machine in which the mass flow rate of molten steel that passes through the submerged entry nozzle 1 is 2.0 tons or more per minute.

Configuration of Submerged Entry Nozzle

Figure 1:
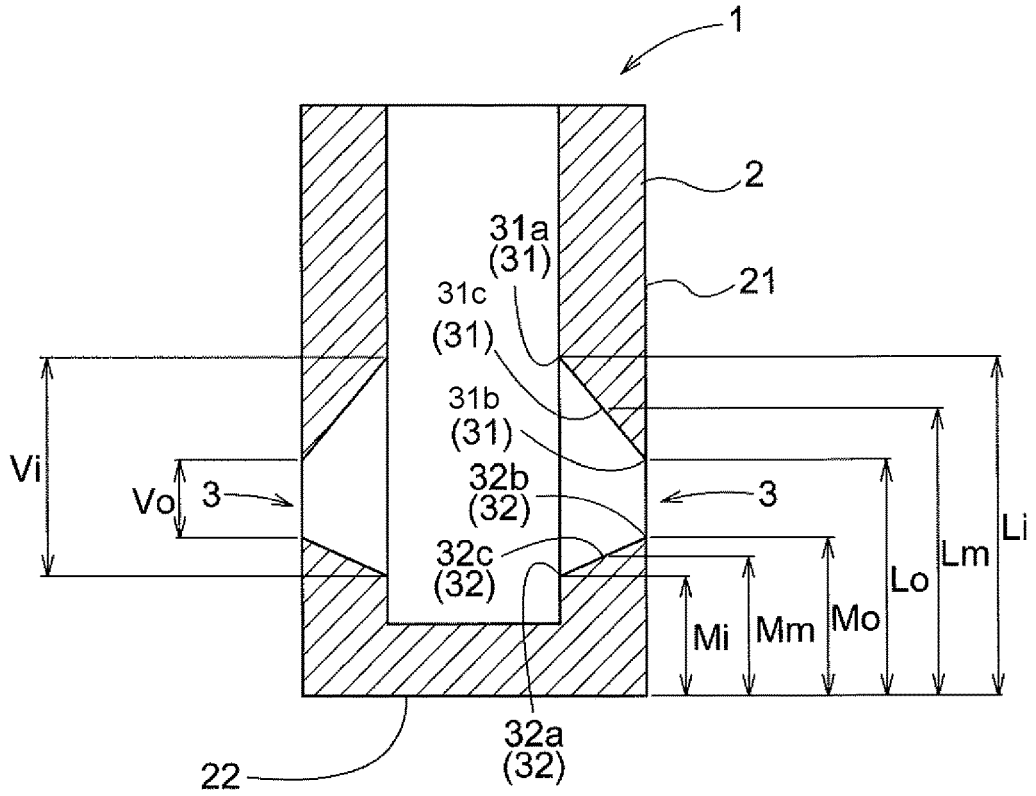
FIG. 1 is a vertical cross-sectional view of a submerged entry nozzle according to an embodiment of the present invention.

The submerged entry nozzle 1 according to the present embodiment has a structure in which two outlet ports 3 are provided in a vertical side face 21 of a bottomed cylinder 2 (FIG. 1). The two outlet ports 3 are open in opposite directions, as shown in FIG. 1. In the following description, the vertical direction is defined based on the orientation of the submerged entry nozzle 1 when in use shown in FIG. 1, i.e., the orientation in which a leading end 22 of the bottomed cylinder 2 is arranged on the lower side.

The bottomed cylinder 2 has a closed-end cylindrical shape with an outer diameter of 140 mm and an inner diameter of 80 mm. The bottomed cylinder 2 is made of a refractory material with a thickness of 30 mm. The refractory material constituting the bottomed cylinder 2 mainly contains an oxide raw material such as alumina, silica, spinel, magnesia, zirconia, zircon, or calcium zirconate, and a carbon raw material such as graphite, carbon black, or pitch, and also contains one or more types of non-oxide additives such as silicon carbide, boron carbide, zirconium boride, aluminum, and silicon nitride.

Figure 2:
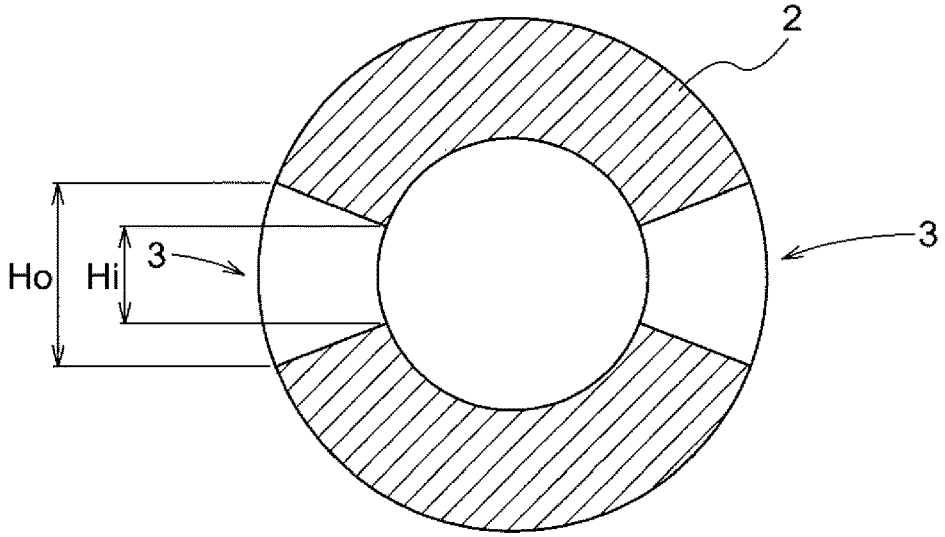
FIG. 2 is a horizontal cross-sectional view of the submerged entry nozzle according to an embodiment of the present invention.

The outlet ports 3 are provided in the vertical side face 21 of the bottomed cylinder 2 (FIGS. 1 and 2). The shape of each outlet port 3 as viewed from a radially outer side of the bottomed cylinder 2 is a substantially oblong shape. As for the vertical opening dimension of each outlet port 3, a vertical opening dimension Vi on the inner side of the bottomed cylinder 2 is larger than a vertical opening dimension Vo on the outer side (FIG. 1). Meanwhile, as for the horizontal opening dimension of each outlet port 3, a horizontal opening dimension Ho on the outer side of the bottomed cylinder 2 is larger than a horizontal opening dimension Hi on the inner side (FIG. 2). More specifically, the dimensions of each part are as shown in the table below.

TABLE 1

| | Inner side | Outer side |
|---|---|---|
| Vertical direction | Vi = 110 mm | Vo = 80 mm |
| Horizontal direction | Hi = 85 mm | Ho = 100 mm |

Based on the above dimensional relationship, Vi/Vo=1.37 and Ho/Hi=1.18. Accordingly, the opening dimensions of each outlet port 3 satisfy the following Expressions (1) and (2).

$$Vi/Vo \geq 1.1 \quad \text{Expression (1)}$$

$$Ho/Hi \geq 1.1 \quad \text{Expression (2)}$$

Each outlet port 3 has an upper edge 31 that extends in a straight line downward from the inner side to the outer side of the bottomed cylinder 2 in a vertical cross-section of the outlet port 3 (FIG. 1). Accordingly, as for the upper edge height, namely the distance between the upper edge 31 of the outlet port 3 and the leading end 22 of the bottomed cylinder 2, an upper edge height Li of an inner upper edge 31*a* is larger than an upper edge height Lo of an outer upper edge 31*b*. Further, an upper edge height Lm at a position 31*c* between the inner upper edge 31*a* and the outer upper edge 31*b* is smaller than the upper edge height Li of the inner upper edge 31*a* and is larger than the upper edge height Lo of the outer upper edge 31*b*. That is, the upper edge heights Li, Lo, and Lm satisfy the following Expression (4).

$$Li>Lm>Lo \quad \text{Expression (4)}$$

Each outlet port 3 has a lower edge 32 that extends in a straight line upward from the inner side to the outer side of the bottomed cylinder 2 in a vertical cross-section of the outlet port 3 (FIG. 1). Accordingly, as for the height of the lower edge, namely the distance between the lower edge 32 of the discharge hole portion 3 and the leading end 22 of the bottomed cylinder 2, a height Mi of an inner lower edge 32*a* is smaller than a height Mo of an outer lower edge 32*b*. Further, a height Mm of the lower edge at a position 32*c* between the inner lower edge 32*a* and the outer lower edge 32*b* is larger than the height Mi of the inner lower edge 32*a* and is smaller than the height Mo of the outer lower edge 32*b*. That is, the heights Mi, Mo, and Mm of the lower edge satisfy the following Expression (5).

$$Mi<Mm<Mo \quad \text{Expression (5)}$$

Note that the heights of the upper edge 31 and the lower edge 32 in the present embodiment are as shown in the following table.

TABLE 2

| | Inner side | Outer side |
|---|---|---|
| Upper edge | Li = 150 mm | Lo = 130 mm |
| Lower edge | Mi = 40 mm | Mo = 50 mm |

Variations

A description will be given below of variations of the shape of the discharge hole portions of the submerged entry nozzle according to the present invention. Note that the same parts as those of the above embodiment are assigned the same reference numerals, and a description thereof is omitted.

Figure 3:
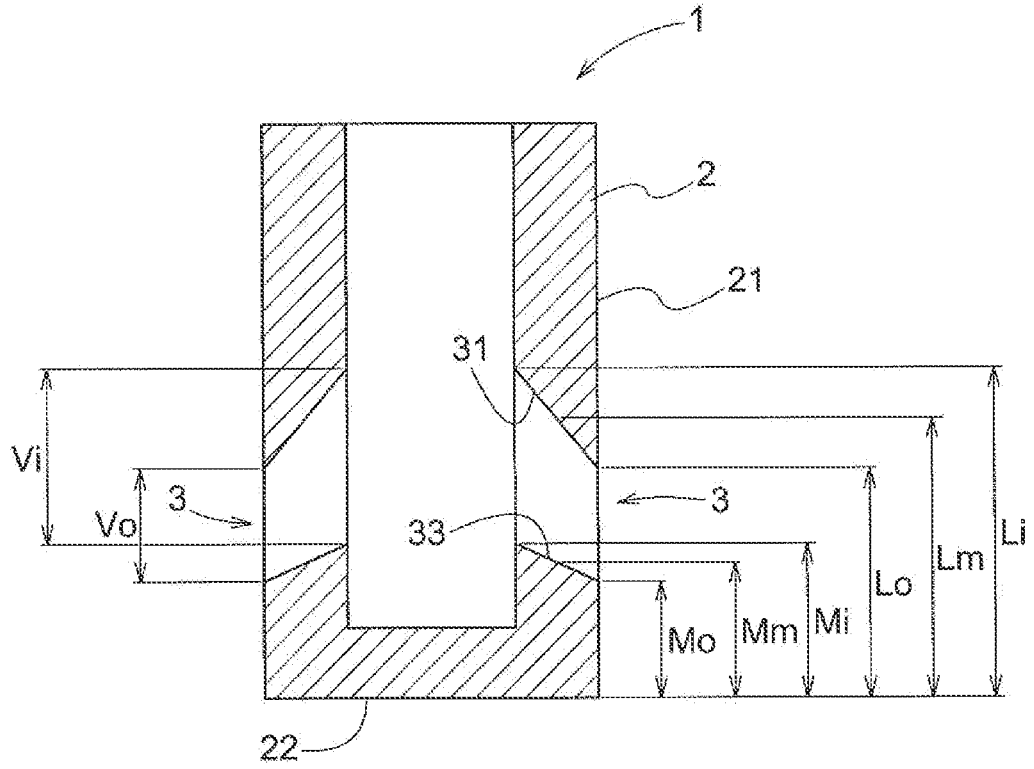
FIG. 3 shows a variation of the submerged entry nozzle according to the embodiment of the present invention.

In a variation shown in FIG. 3, each discharge hole portion 3 has a lower edge 33 that extends in a straight line downward from the inner side to the outer side of the bottomed cylinder 2. That is, the extension direction of the lower edge is reversed from that of the above embodiment. Note that the upper edge 31 is the same as that of the above embodiment. Accordingly, the following Expressions (4) and (6) hold in the variation shown in FIG. 3.

$$Li>Lm>Lo \quad \text{Expression (4)}$$

$$Mi>Mm>Mo \quad \text{Expression (6)}$$

Figure 4:
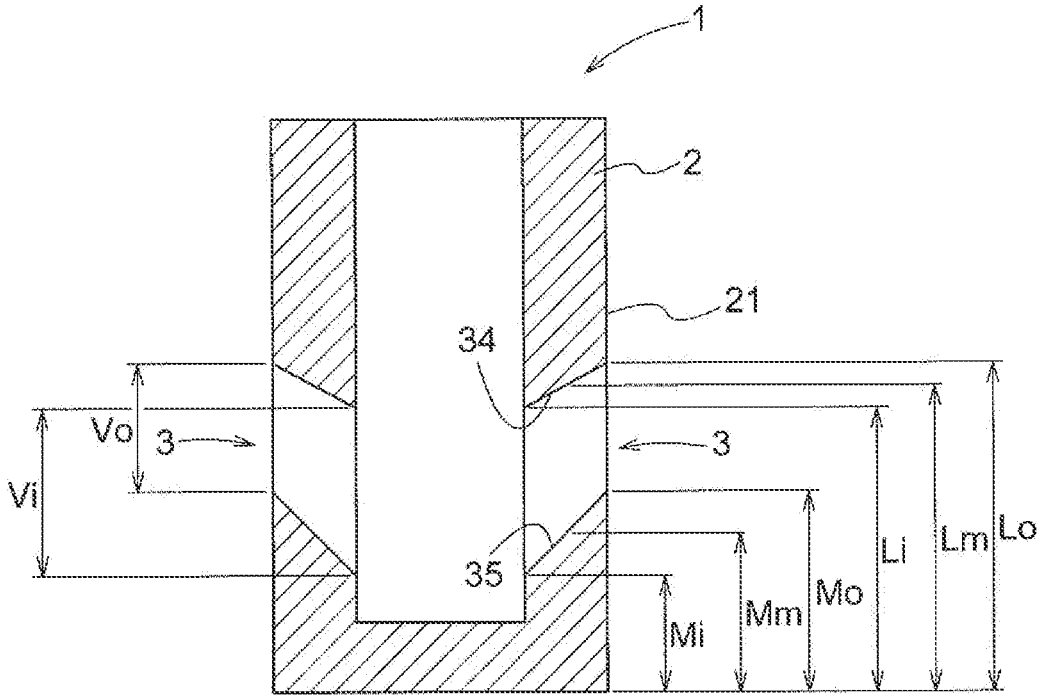
FIG. 4 shows a variation of the submerged entry nozzle according to the embodiment of the present invention.

In a variation shown in FIG. 4, each discharge hole portion 3 has an upper edge 34 that extends in a straight line upward from the inner side to the outer side of the bottomed cylinder 2. That is, the extension direction of the upper edge is reversed from that of the above embodiment. Note that a lower edge 35 has a different inclination angle from the lower edge 32 in the above embodiment, but the relationship between the heights of the lower edge is the same as that of the above embodiment. Accordingly, the following Expressions (3) and (5) hold in the variation shown in FIG. 4.

$$Li<Lm<Lo \quad \text{Expression (3)}$$

$$Mi<Mm<Mo \quad \text{Expression (5)}$$

Figure 5:
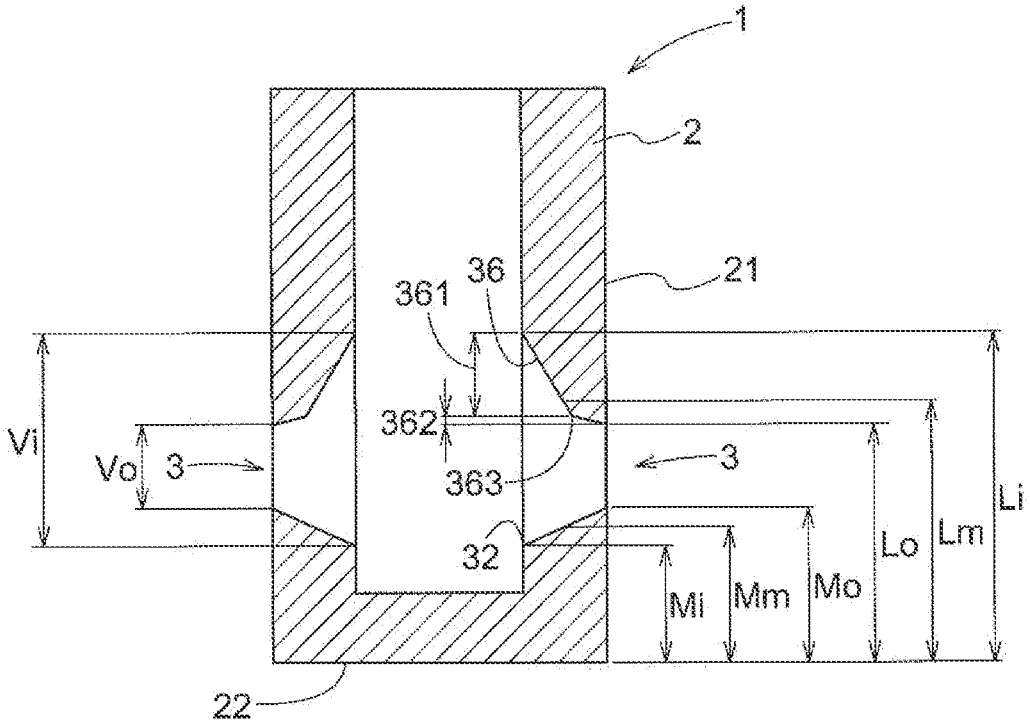
FIG. 5 shows a variation of the submerged entry nozzle according to the embodiment of the present invention.

In a variation shown in FIG. 5, each outlet port 3 has an upper edge 36 having a shape in which two straight lines 361 and 362, which extend downward from the inner side to the outer side of the bottomed cylinder 2, are connected at a connection point 363 in a vertical cross-section of the outlet port 3. However, the above Expression (4) holds over the entire area of the upper edge 36 since both the inner straight line 361 and the outer straight line 362 extend downward from the inner side to the outer side of the bottomed cylinder 2.

Figure 6:
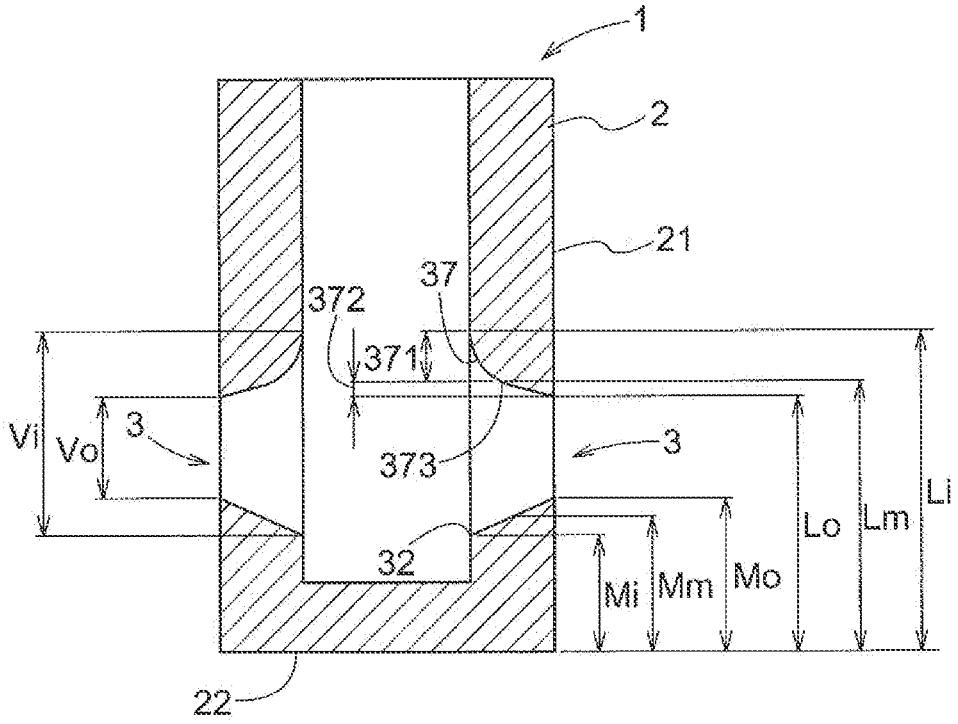
FIG. 6 shows a variation of the submerged entry nozzle according to the embodiment of the present invention.

In a variation shown in FIG. 6, each outlet port 3 has an upper edge 37 having a shape with a curved line 371 extending downward from the inner side toward the outer side of the bottomed cylinder 2 in a vertical cross-section of the outlet port 3, and a straight line 372 extending downward continuously from this curved line, the curved line 371 and the straight line 372 being connected at a connection point 373. However, the above Expression (4) holds over the entire area of the upper edge 37 since both the curved line 371 and the straight line 372 extend downward from the inner side to the outer side of the bottomed cylinder 2.

Figure 7:
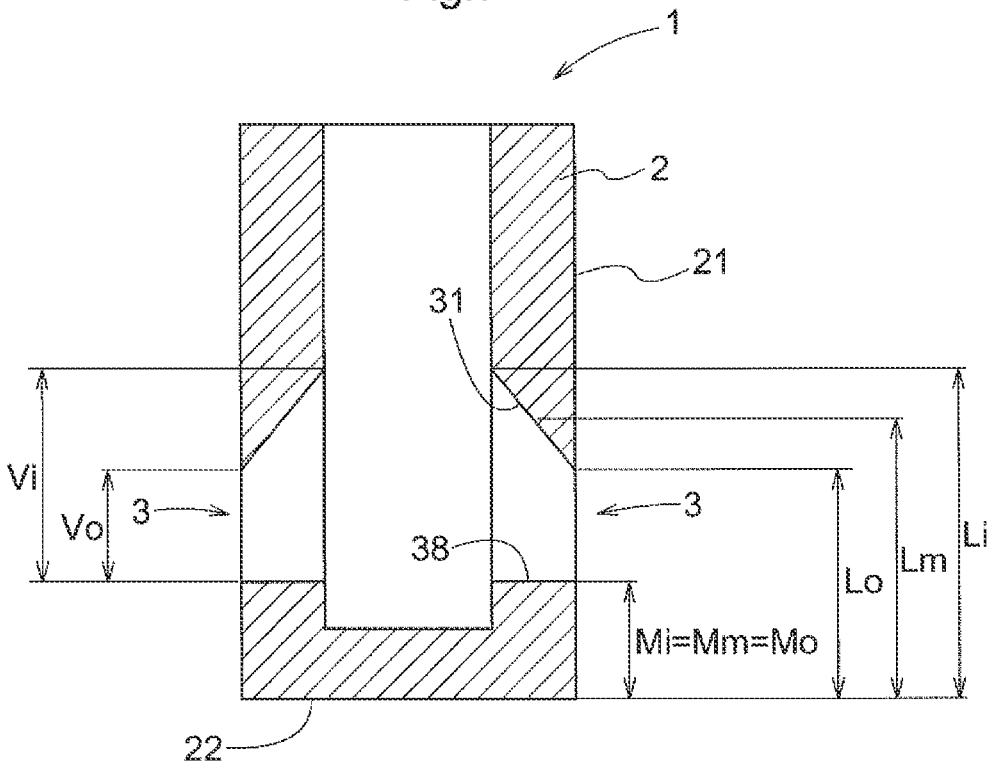
FIG. 7 shows a variation of the submerged entry nozzle according to the embodiment of the present invention.

In a variation shown in FIG. 7, each outlet port 3 has a lower edge 38 extending in a straight line horizontally from the inner side to the outer side of the bottomed cylinder 2 in a vertical cross-section of the lower edge 38. Note that the upper edge 31 is the same as that of the above embodiment. Accordingly, the above Expression (4) and the following Expression (7) hold in the variation shown in FIG. 3.

$$Mi=Mm=Mo \quad \text{Expression (7)}$$

Note that Expressions (1) and (2) related to the vertical opening dimension of each outlet port 3 and the horizontal opening dimension thereof hold, similarly to the above embodiment, in each of the above-described variations.

$$Vi/Vo \geq 1.1 \quad \text{Expression (1)}$$

$$Ho/Hi \geq 1.1 \quad \text{Expression (2)}$$

Other Embodiments

The following is a description of other embodiments of the submerged entry nozzle according to the present invention. Note that the configuration disclosed in each of the following embodiments can also be combined with the configurations disclosed in the other embodiments as long as no contradiction arises.

The above embodiment has described an example configuration in which each outlet port 3 has a substantially oblong shape as viewed from the radially outer side of the bottomed cylinder 2. However, the outlet port according to the present invention as viewed from the radially outer side of the bottomed cylinder is not limited to this configuration, and may alternatively have, for example, a rectangular shape, an oval shape, or an elliptical shape.

The above embodiment has described an example configuration in which two outlet ports 3 that are open in opposite directions are provided. However, there is no limitation to this configuration, and the submerged entry nozzle according to the present invention may have three or more outlet ports. However, since many molds have oblong shapes, molten steel can be discharged along the longer sides of a mold if this mold has two outlet ports that are open in opposite directions. This configuration is unlikely to cause a discharge flow that directly collides with the longer sides of the mold, thus making it easy to suppress damage to the mold.

The above embodiment has described an example configuration in which the bottomed cylinder 2 has a closed-end cylindrical shape with an outer diameter of 140 mm and an inner diameter of 80 mm. However, the shape of the bottomed cylinder is not specifically limited in the submerged entry nozzle according to the present invention. For example, the shape of an inner tube portion of the bottomed cylinder may have a shape whose diameter partially decreases, a shape with a plurality of hemispherical or droplet-like protrusions, a shape with droplet-like protrusions that are continuous in the circumferential direction, or the like. Alternatively, the bottomed cylinder may contain a highly breathable material arranged in the inner tube portion, and may be given a function of blowing a gas from the inner tube during casting. Note that the dimensions of the bottomed cylinder are determined with consideration given to usage conditions (the flow rate of molten steel etc.) of the submerged entry nozzle.

The above embodiment has described a configuration envisioned for application to a continuous slab-casting machine in which the mass flow rate of molten steel that passes through the submerged entry nozzle 1 is 2.0 tons or more per minute. However, the mass flow rate of molten steel that passes through the submerged entry nozzle according to the present invention is not specifically limited. However, a mass flow rate of 2.0 tons or more per minute is favorable in that the effect of reducing the flow velocities of the meniscus flow and the short-side downward flow is particularly apparent. Note that a mass flow rate of 2.5 tons or more per minute is more favorable.

The above embodiment has described an example of using the submerged entry nozzle according to the present invention in a continuous slab-casting machine. However, there is no limitation to this configuration. The submerged entry nozzle according to the present invention can also be used in a continuous bloom-casting machine as well as a continuous slab-casting machine.

As for other configurations as well, the embodiments disclosed in the present specification are examples in all respects, and it should be understood that the scope of the present invention is not limited thereby. A person skilled in the art would readily understand that the embodiments can be modified as appropriate without departing from the gist of the present invention. Accordingly, other embodiments that are modifications made without departing from the gist of the present invention are naturally included in the scope of the present invention.

Examples

The present invention will be further described while illustrating non-limiting examples of the submerged entry nozzle according to the present invention.

Analysis of Turbulent Energy with Computer Simulation

Figure 8:
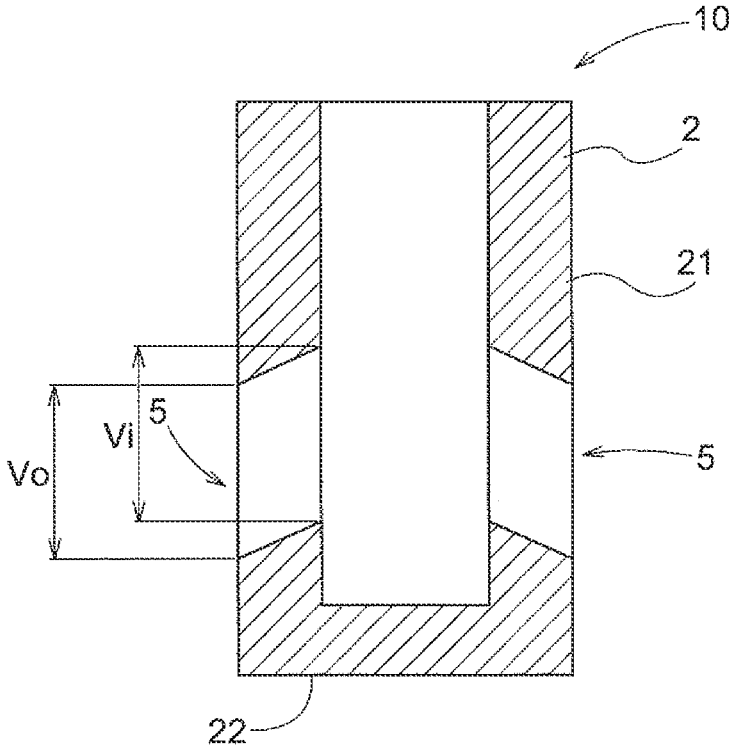
FIG. 8 is a vertical cross-sectional view of a conventional submerged entry nozzle.

Computer simulations were conducted on the distribution of turbulent energy values of a discharge flow around a discharge hole portion for submerged entry nozzles 1 (FIG. 1, examples) according to the above embodiment and submerged entry nozzles 10 (FIG. 8, comparative examples) having outlet ports 5 with a conventional shape. Note that each outlet port 5 of the submerged entry nozzles 10 in the comparative examples has an upper edge 51 and a lower edge 52 that are parallel to each other. Accordingly, Vi=Vo and Vi/Vo=1.0. Further, although not shown in the figures. Hi=Ho and Hi/Ho=1.0. Note that in these simulations, the mass flow rate of molten steel that passes through the submerged entry nozzles was 2.0 tons per minute.

Figure 9:
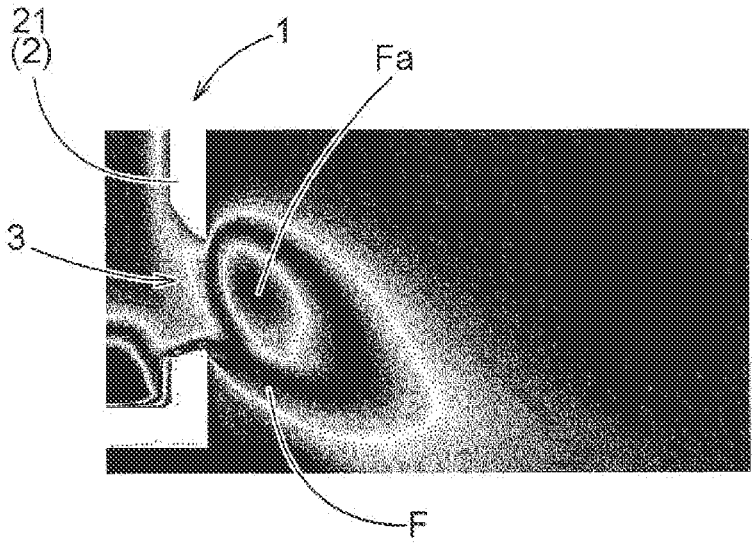
FIG. 9 shows a result of a simulation with the submerged entry nozzle according to the embodiment of the present invention.
Figure 10:
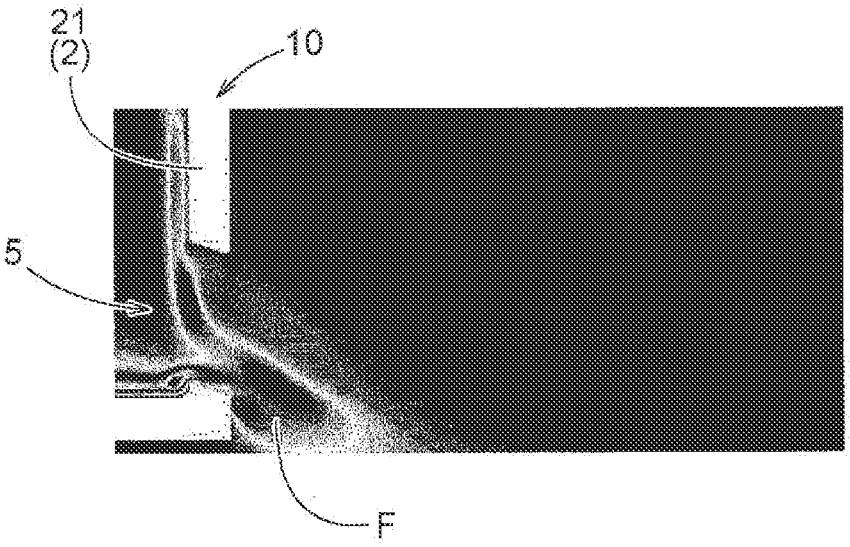
FIG. 10 shows a result of a simulation with the conventional submerged entry nozzle.

FIG. 9 shows the result of the computer simulations of discharge flows F obtained with the submerged entry nozzles 1 according to the embodiment of the present invention. In FIG. 9, a distinct concentration Fa of turbulent energy is observed outside the outlet port 3. On the other hand, no such concentration of turbulent energy as that found in FIG. 9 was observed in the computer simulations of discharge flows F obtained with the submerged entry nozzles 10 having the outlet ports 5 with the conventional shape (FIG. 10).

The above simulation results indicate that kinetic energy of the discharge flows is consumed as turbulent energy with the submerged entry nozzle according to the present invention. With the submerged entry nozzles according to the present invention, it is thought that the above-described energy consumption causes the flow velocities of the meniscus flow and the short-side downward flow to be significantly lower than in the case of conventional submerged entry nozzles.

Water Model Test

Figure 11:
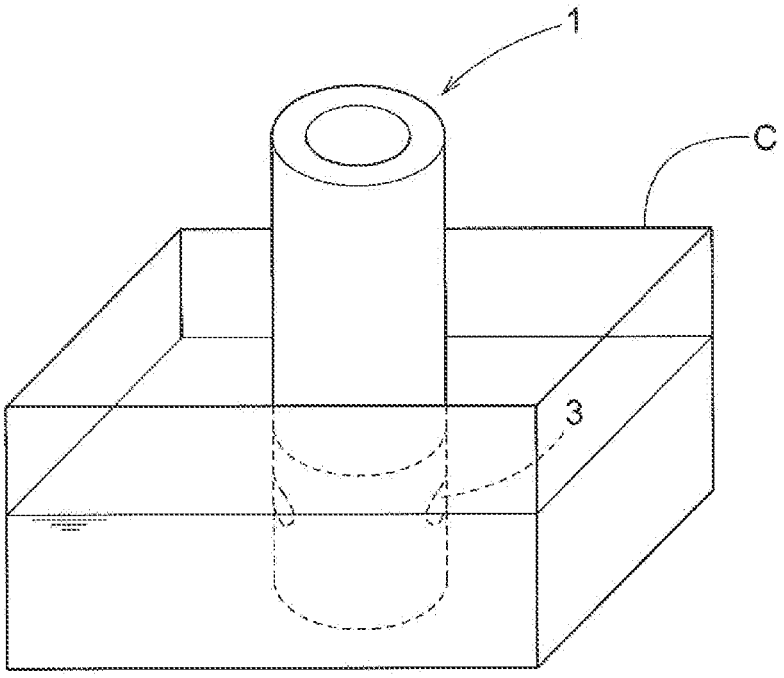
FIG. 11 illustrates a method of conducting a water model test.

A submerged entry nozzle was created with two outlet ports in a vertical side face of a bottomed cylinder with an outer diameter of 140 mm and an inner diameter of 80 mm, similarly to the above embodiment. Note that the dimensions of the outlet ports in the examples and the comparative examples will be described later. The leading end of each submerged entry nozzle was put into water collected in a mold C with a size of 240 mm 1400 mm, and thereafter, 700 kg of water per minute (5 tons per minute in terms of molten steel) was drained from the submerged entry nozzle (FIG. 11). The flow velocities of the meniscus flow and the short-side downward flow were measured with use of a propeller-type flow meter after at least 15 minutes since water started to be drained.

First, as a standard example (comparative example 1), a test was conducted on the submerged entry nozzle 10 (FIG. 7) having the outlet ports 5 with a conventional shape, and the flow velocities of the meniscus flow and the short-side downward flow were measured. In the comparative example 1, Vi/Vo=1.0 and Hi/Ho=1.0. In the following example tests (examples and comparative examples), the flow velocities of the meniscus flow and the short-side downward flow were represented by index values while assuming that the flow velocities of the meniscus flow and the short-side downward flow in the comparative example 1 were both 100. The example tests were evaluated based on these index values as follows.

Evaluation A: The index values of both the meniscus flow and the short-side downward flow are less than 95

Evaluation B: The index value of at least either the meniscus flow or the short-side downward flow is 95 or more Table 3 below shows the index values of the flow velocities of the meniscus flow and the short-side downward flow in examples 1 to 6 and comparative examples 1 to 3 with various values of Ho/Hi and Vi/Vo. Note that in the submerged entry nozzles in the examples 1 to 6 and the comparative examples 1 to 3, the extension directions of the upper edge and the lower edge of each outlet port 3 are the same as those in FIG. 1. That is, in a vertical cross-section, the upper edge extends in a straight line downward from the inner side to the outer side of the bottomed cylinder, and the lower edge extends in a straight line upward from the inner side to the outer side.

The flow velocities of both the meniscus flow and the short-side downward flow were effectively reduced when the values of Ho/Hi and Vi/Vo satisfied Expressions (1) and (2), as indicated in the examples 1 to 6. On the other hand, a sufficient flow velocity reduction effect was not obtained in the comparative examples 1 to 3 that do not satisfy at least either Expression (1) or (2).

$$Vi/Vo \geq 1.1 \quad \text{Expression (1)}$$

$$Ho/Hi \geq 1.1 \quad \text{Expression (2)}$$

TABLE 3

| | Ex. 1 | Ex. 2 | Ex. 3 | Ex. 4 | Ex. 5 | Ex. 6 | Comp. Ex. 1 | Comp. Ex. 2 | Comp. Ex. 3 |
|---|---|---|---|---|---|---|---|---|---|
| Ho/Hi | 1.18 | 1.10 | 1.10 | 1.10 | 1.10 | 1.30 | 1.00 | 1.10 | 1.05 |
| Vi/Vo | 1.37 | 1.10 | 1.50 | 2.00 | 2.50 | 1.50 | 1.00 | 1.05 | 1.50 |
| Meniscus flow velocity | 81 | 90 | 88 | 84 | 80 | 81 | 100 | 96 | 105 |
| Short-side downward flow velocity | 59 | 69 | 67 | 61 | 56 | 65 | 100 | 94 | 73 |
| Evaluation | A | A | A | A | A | A | B | B | B |

Table 4 below shows index values of the flow velocities of the meniscus flow and the short-side downward flow in examples 4, 7, and 8 in which the values of Ho/Hi and Vi/Vo were fixed while the shape of the lower edge of each outlet port was changed. The shapes of the lower edge in the examples 4, 7, and 8 correspond to FIGS. 1, 7, and 3, respectively. That is, the following Expression (5) holds in the example 4, the following Expression (7) holds in the example 5, and the following Expression (6) holds in the example 8.

$$Mi<Mm<Mo \quad \text{Expression (5)}$$

$$Mi>Mm>Mo \quad \text{Expression (6)}$$

$$Mi=Mm=Mo \quad \text{Expression (7)}$$

The flow velocities of both the meniscus flow and the short-side downward flow were effectively reduced regardless of the shape of the lower edge of each outlet port, as indicated in the examples 4, 7, and 8. Note that the flow velocity of the meniscus flow was reduced most effectively in the example 8, and the flow velocity of the short-side downward flow was reduced most effectively in the example 4. Accordingly, it was found that the shape of the lower edge of the outlet port that extends upward can be adopted if there is a desire to reduce the flow velocity of the short-side downward flow in particular.

TABLE 4

| | Ex. 4 | Ex. 7 | Ex. 8 | Ex. 1 |
|---|---|---|---|---|
| Ho/Hi | 1.10 | 1.10 | 1.10 | 1.00 |
| Vi/Vo | 2.00 | 2.00 | 2.00 | 1.00 |
| Magnitude relationship for lower edge heights | Exp. (5) | Exp. (7) | Exp. (6) | — |
| Meniscus flow velocity | 84 | 81 | 70 | 100 |
| Short-side downward flow velocity | 61 | 73 | 81 | 100 |
| Evaluation | A | A | A | B |

INDUSTRIAL APPLICABILITY

The present invention can be used for a submerged entry nozzle for a continuous slab-casting machine, for example.

DESCRIPTION OF REFERENCE SIGNS

1: Submerged entry nozzle
2: Bottomed cylinder
21: Vertical side face of bottomed cylinder
22: Leading end of bottomed cylinder
3: Outlet port
31: Upper edge
32: Lower edge
33: Lower edge (variation)
34: Upper edge (variation)
35: Lower edge (variation)
36: Upper edge (variation)
37: Upper edge (variation)
38: Lower edge (variation)
Hi: Horizontal opening dimension (inner side)
Ho: Horizontal opening dimension (outer side)
Vi: Vertical opening dimension (inner side)
Vo: Vertical opening dimension (outer side)
Li: Upper edge height (inner side)
Lm: Upper edge height (at position between inner side and outer side)
Lo: Upper edge height (outer side)
Mi: Height of lower edge (inner side)
Mm: Height of lower edge (at position between inner side and outer side)
Mo: Height of lower edge (outer side)
F: Discharge flow (simulation)
Fa: Concentration of turbulent energy (simulation)
C: Mold

The invention claimed is:

1. A submerged entry nozzle, comprising:

a bottomed cylinder having a vertical side face with at least two outlet ports and having an inner side and an outer side, wherein a bottom end of the cylinder is a closed end, and wherein the following expressions are satisfied:

$$Vi/Vo>1.1 \quad \text{Expression (1) and}$$

$$Ho/Hi>1.1 \quad \text{Expression (2),}$$

where Vi indicates a vertical opening dimension of each of the at least two outlet ports on the inner side, Hi indicates a horizontal opening dimension of each of the at least two outlet ports on the inner side, Vo indicates a vertical opening dimension of each of the at least two outlet ports on the outer side, and Ho indicates a horizontal opening dimension of each of the at least two outlet ports on the outer side.

2. The submerged entry nozzle according to claim 1, wherein the following expressions are satisfied:

$$Li<Lm<Lo \quad \text{Expression (3) or}$$

$$Li>Lm>Lo \quad \text{Expression (4),}$$

where Li indicates an upper edge height on the inner side, the upper edge height being a distance between an upper edge of each of the at least two outlet ports and a leading end of the bottomed cylinder, Lo indicates the upper edge height on the outer side, and Lm indicates the upper edge height at a position between the inner side and the outer side, and $$Mi<Mm<Mo \quad \text{Expression (5) or}$$

$$Mi>Mm>Mo \quad \text{Expression (6),}$$

where Mi indicates a lower edge height on the inner side, the lower edge height being a distance between a lower edge of each of the at least two outlet ports and the leading end of the bottomed cylinder, Mo indicates the lower edge height on the outer side, and Mm indicates the lower edge height at a position between the inner side and the outer side.

3. The submerged entry nozzle according to claim 2, wherein the upper edge height satisfies Expression (4), and the lower edge height satisfies Expression (5).

* * * * *